United States Patent [19]

Yoshiba

[11] 4,321,599

[45] Mar. 23, 1982

[54] HIGH LEGIBILITY MULTI-CHARACTER DOT MATRIX DISPLAY

[75] Inventor: Yutaka Yoshiba, Tokyo, Japan

[73] Assignee: Ricoh Company, Ltd., Tokyo, Japan

[21] Appl. No.: 99,349

[22] Filed: Dec. 3, 1979

[30] Foreign Application Priority Data

Dec. 20, 1978 [JP] Japan ..... 53/159434

[51] Int. Cl.[3] ..... G09G 1/16

[52] U.S. Cl. ..... 340/804; 178/30; 340/797; 340/750

[58] Field of Search ..... 178/15, 30; 340/723, 340/794, 795, 797, 804, 744, 748, 750

[56] References Cited

U.S. PATENT DOCUMENTS

| | | | |
|---|---|---|---|
| 3,274,581 | 9/1966 | Moore et al. | 340/795 |
| 3,281,822 | 10/1966 | Evans | 340/794 |
| 4,074,254 | 7/1976 | Belser et al. | 178/30 |

*Primary Examiner*—Marshall M. Curtis

*Attorney, Agent, or Firm*—David G. Alexander

[57] ABSTRACT

A character generator (14) applies character columns in a standard 5×7 or similar matrix form to a multi-digit dot matrix display (12). Inhibition circuitry (33), (23) eliminates all character columns containing no character dots. Additional circuitry (19), (33) ensures that there will be one blank column between adjacent characters. This arrangement increases the legibility of the display and enables more characters to be displayed in the same space.

6 Claims, 6 Drawing Figures

Fig. 1 PRIOR ART
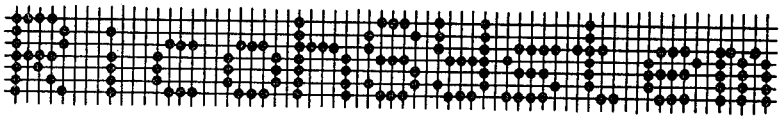
Fig. 2
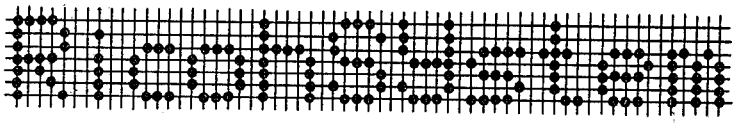
Fig. 3
| | A | | | | | I | | | | | i | | | | |
|---|---|---|---|---|---|---|---|---|---|---|---|---|---|---|---|
| | $t_1$ | $t_2$ | $t_3$ | $t_4$ | $t_5$ | $t_1$ | $t_2$ | $t_3$ | $t_4$ | $t_5$ | $t_1$ | $t_2$ | $t_3$ | $t_4$ | $t_5$ |
| $O_1$ | 0 | 0 | 1 | 0 | 0 | 0 | 1 | 1 | 1 | 0 | 0 | 0 | 0 | 0 | 0 |
| $O_2$ | 0 | 1 | 0 | 1 | 0 | 0 | 0 | 1 | 0 | 0 | 0 | 0 | 1 | 0 | 0 |
| $O_3$ | 1 | 0 | 0 | 0 | 1 | 0 | 0 | 1 | 0 | 0 | 0 | 0 | 0 | 0 | 0 |
| $O_4$ | 1 | 0 | 0 | 0 | 1 | 0 | 0 | 1 | 0 | 0 | 0 | 0 | 1 | 0 | 0 |
| $O_5$ | 1 | 1 | 1 | 1 | 1 | 0 | 0 | 1 | 0 | 0 | 0 | 0 | 1 | 0 | 0 |
| $O_6$ | 1 | 0 | 0 | 0 | 1 | 0 | 0 | 1 | 0 | 0 | 0 | 0 | 1 | 0 | 0 |
| $O_7$ | 1 | 0 | 0 | 0 | 1 | 0 | 1 | 1 | 1 | 0 | 0 | 0 | 1 | 0 | 0 |
| IF | 1 | 1 | 1 | 1 | 1 | 0 | 1 | 1 | 1 | 0 | 0 | 1 | 1 | 1 | 0 |

HIGH LEGIBILITY MULTI-CHARACTER DOT MATRIX DISPLAY

BACKGROUND OF THE INVENTION

The present invention relates to a multi-character dot matrix display for word processor, electronic memory typewriters and the like.

Dot matrix displays are well known in the art and widely used. Inexpensive word processors, for example, comprise displays for displaying on the order of 20 characters, digits, symbols and the like of a line being input or edited in the 5×7, 7×9 or similar format. Each character occupies a space of fixed size on the display in the manner of a conventional typewriter.

However, due to the limited number of dots for forming each character, it is not possible to form in a fixed space, all characters in an aesthetically pleasing manner as is possible with typewriter fonts. For example, characters such as "i" and "t" occupy only a limited horizontal portion of the fixed space with blank areas on either side of the characters. This provides an aesthetically unattractive display which is not particularly legible. Although blank areas on either side of narrow characters may be eliminated in a cathode-ray-tube display system, it has not been heretofore possible with a hard-wired dot matrix display.

SUMMARY OF THE INVENTION

A dot matrix display apparatus embodying the present invention includes a multi-character dot matrix display means, character generator means for generating and applying to the display means columns of characters corresponding to input character codes and column designation means for sequentially designating column positions in the display means for displaying the columns, and is characterized by comprising inhibition means for inhibiting the column designation means from designating a next column position when a column generated by the character generator means does not contain a character dot.

In a multi-character dot matrix display, character columns containing no character dots are eliminated although blank columns between characters are retained, increasing the legibility of the display and enabling more characters to be displayed in the same space.

It is an object of the present invention to provide a multi-character dot matrix display featuring improved legibility and aesthetic quality of display.

It is another object of the present invention to provide a multi-character dot matrix display which enables an increased number of characters to be displayed in the same space.

It is another object of the present invention to provide a generally improved multi-character dot matrix display.

Other objects, together with the foregoing, are attained in the embodiments described in the following description and illustrated in the accompanying drawing.

BRIEF DESCRIPTION OF THE DRAWING

FIG. 1 is a graphic representation of a prior art dot matrix display;

FIG. 2 is a graphic representation of a dot matrix display in accordance with the present invention;

FIG. 3 is a table indicating columns of character dot data stored in a character generator in accordance with the present invention;

DESCRIPTION OF THE PREFERRED EMBODIMENTS

Figure 4:
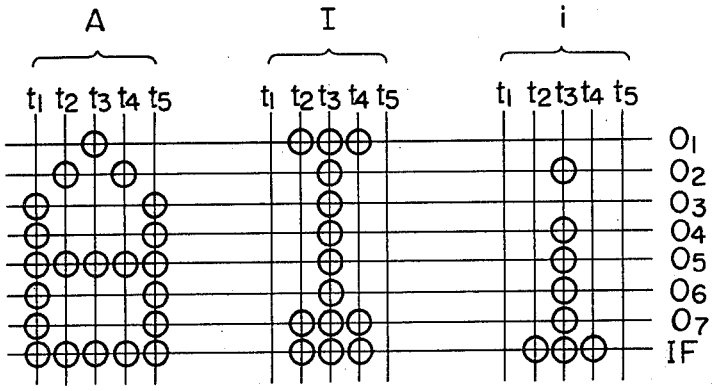
FIG. 4 is a diagram further illustrating the dot data.

While the multi-character dot matrix display of the present invention is susceptible of numerous physical embodiments, depending upon the environment and requirements of use, substantial numbers of the herein shown and described embodiments have been made, tested and used, and all have performed in an eminently satisfactory manner.

FIG. 1 of the drawing illustrates a representation in 5×7 dot matrix format of the message "RicohSystem". Each character occupies the same 5×7 dot space. However, narrow characters like "i", "t", "j", etc. do not have character dots (dark points) in every column. For example, the character "i" is illustrated as having dots in only one column. Thus, four out of the five columns in the character space are blank. This creates blank spaces on either side of the character which are aesthetically unpleasing and make the display hard to read.

FIG. 2 shows how the display is improved in accordance with the present invention. Unnecessary blank spaces are eliminated, making the display much more aesthetic and easier to read. In addition, the message does not require as much space as in the prior art. In the illustrated example, the message "RicohSystem" requires 65 columns in accordance with the prior art but only 61 columns in accordance with the present invention. The elimination of aesthetically unattractive and unnecessary blank spaces provides another benefit in that more characters can be displayed in the same space. The space saving increases in proportion to the number of narrow characters such as "i", "t", "l", "j", "I" and "J" in the line.

Figure 5:
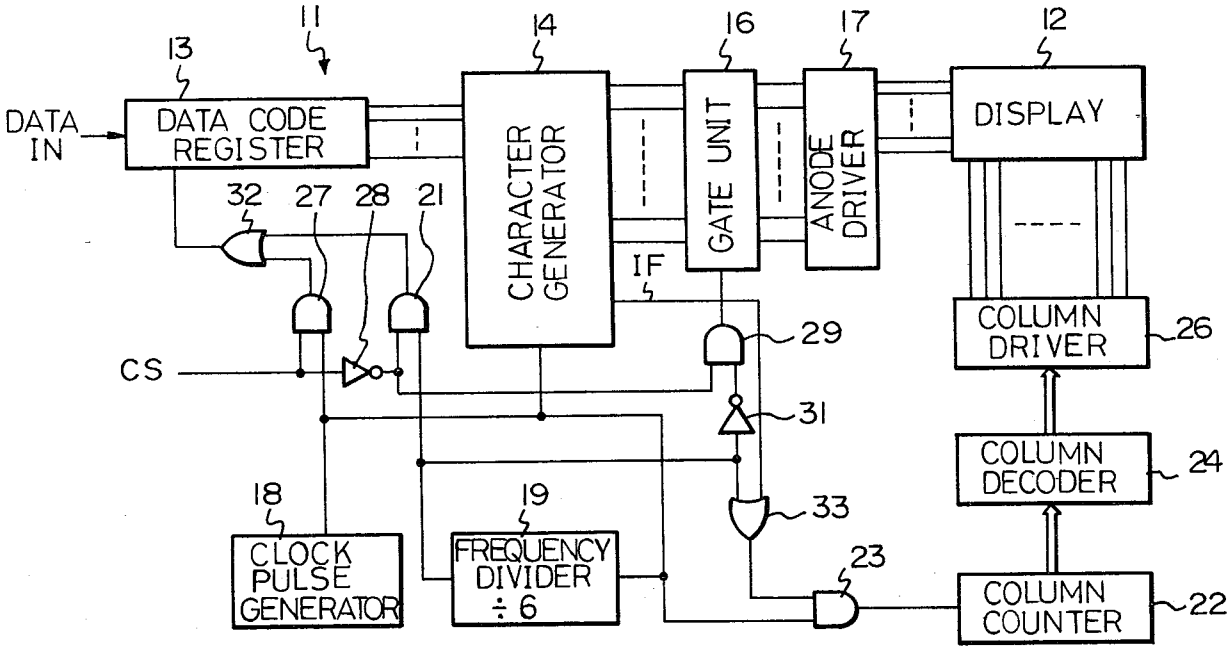
FIG. 5 is a block diagram of a multi-character dot matrix display apparatus embodying the present invention.

Referring now to FIG. 5, a multi-character display apparatus embodying the present invention is generally designated by the reference numeral 11 and comprises a multi-character display 12. Any commercially available display may be used in accordance with the present invention, with an example of the general type being the TIL507 5×7 alphanumeric display manufactured by Texas Instruments, Inc. A plurality of these units may be connected together or an integral display may be selected to display any number of characters, with a typical number being twenty.

Codes representing characters, numbers, symbols and the like to be displayed on the display 12 in a convenient arrangement such as the well known ACSII format are fed into a data code register 13. The register 13 may be a recirculating shift register, random access memory or the like which is constructed to repeatedly feed out the codes and apply them in a parallel manner to a character generator 14. The character generator 14 feeds out vertical columns of dot signals representing the characters one column at a time. The column signals are fed through a gate unit 16 and anode driver 17 to the display 12. In this manner, the columns of the display 12 are driven sequentially to emit light in accordance with the dot signals many times per second to create the illusion of a constantly lighted display through persistence of vision.

The codes are fed from the register 13 to parallel address inputs of the character generator 14 in synchronism with clock pulses from a clock pulse generator 18 divided in frequency by a frequency divider 19 applied through an AND gate 21. For a 5×7 dot matrix display, the frequency division ratio of the frequency divider 19 is six, allowing a blank column to be produced between adjacent characters. In other words, every sixth clock pulse is applied to the register 13 causing the next character code to appear at the output thereof. The unaltered clock pulses are applied to the character generator 14 which comprises an internal counter (not shown).

Typically, the codes in the register 13 will comprise six bits each to accommodate a set of 64 characters and seven bits each to accommodate a set of 128 characters. The register 13 has a capacity to store the maximum number of characters which may be displayed on the display 12.

An example of the configuration of the character generator 14 is illustrated in FIG. 3. Initially, the code for the first character to be displayed appears at the output of the register 13. In response to the first clock pulse, designated at t1, the character generator 14 outputs the first vertical column of the first character. Assuming that the first three characters are "A", "I" and "i", the column dot signals are such as shown in FIG. 3, with the dot signals from the first row to the seventh row being designated as 01 to 07 respectively. The dot signals 01 to 07 for the first column of the character "A" appearing in synchronism with the clock pulse t1 are 0011111 respectively. The appearance of the display is illustrated in FIG. 4.

In response to the second to fifth clock pulses t2 to t5, the second to fifth columns of the character "A" are applied to the display 12 from the character generator 14. As will become clear from further description, a blank column is added at the end of each character for legibility. In response to the sixth clock pulse, the frequency divider 19 will produce a high output which is applied to the register 13, causing the next character code to appear at the output of the register 13. This process is repeated to display all of the characters many times per second.

The output of the clock pulse generator 18 is also connected to a column counter 22 through an AND gate 23. The column counter 22 is incremented by each clock pulse gated through the AND gate 23. The output of the counter 22 is connected to a column decoder 24 which has an output connected to a column driver 26. The column driver 26 has outputs connected to the display 12. The counter 22, decoder 24 and driver 26 are constructed in such a manner that incrementation of the counter 22 causes the columns in the display 12 to be sequentially enabled for display. When the count in the counter 22 is zero, the first column in the display 12 will be enabled. When the count in the counter 22 is maximum, the last column in the display 12 will be enabled.

The row outputs of the anode driver 17 are applied to corresponding row inputs of all dot elements in the display 12. The outputs of the column driver 26 are connected to column inputs of all dot elements in a corresponding column in the display 12. Thus, the column driver 26 will produce an output to enable or select a particular column in the display 12. The dot elements, typically light emitting diodes, which are energized to emit light in the selected column are those for which the dot signals from the anode driver 17 are logically high, indicating character dots in the corresponding positions in the column. Character dots are indicated by logical 1 in FIG. 3.

It will thus be seen that the character generator 14 sequentially generates the columns of the characters to be displayed while the column decoder 22 sequentially selects the column positions in the display 12 to display the corresponding columns.

The apparatus 11 further comprises an AND gate 27. A control signal CS is applied directly to an input of the AND gate 27 and through an inverter 28 to an input of the AND gate 21. Another input of the AND gate 27 is connected to the output of the clock pulse generator 18. The output of the inverter 28 is connected to an input of an AND gate 29, the output of which is connected to the gate unit 16. The output of the frequency divider 19 is connected to another input of the AND gate 29 through an inverter 31. The outputs of the AND gates 21 and 27 are connected to inputs of an OR gate 32, the output of which is connected to a clock input of the register 13.

To input data codes into the register 13, the control signal CS is made logically high, enabling the AND gate 27 and inhibiting the AND gate 21. This allows the clock pulses from the generator 18 to be applied directly to the clock input of the register 13 so that the data codes may be input at high speed. The low output of the inverter 28 inhibits the AND gate 29 which produces a low output. The low output of the AND gate 29 inhibits the gate unit 16 which prevents the output of the character generator 14 from being applied to the anode driver 17 and display 12.

To display the characters in the register 13, the signal CS is made low, enabling the AND gate 21 and inhibiting the AND gate 27. This causes the frequency divided clock pulses from the divider 19 to be applied to the register 13 to output the codes in response to each sixth clock pulse. Assuming that a blank intercharacter column is not being produced, the output of the frequency divider 19 will be low so that the AND gate 29 will produce a high output. The high output of the AND gate 29 will enable the gate unit 16 to gate the output signals from the character generator 14 to the display 12.

The output of the frequency divider 19 is also connected to an input of the AND gate 23 through an OR gate 33. During the times when the blank columns between characters are being produced, the output of the frequency divider 19 will be high to inhibit the gate unit 16 as described above. The high output of the frequency divider 19 also unconditionally enables the AND gate 23, so that the clock pulses corresponding to the blank columns are gated through the AND gate 23 from the clock pulse generator 18 to the column counter 22.

Figure 6:
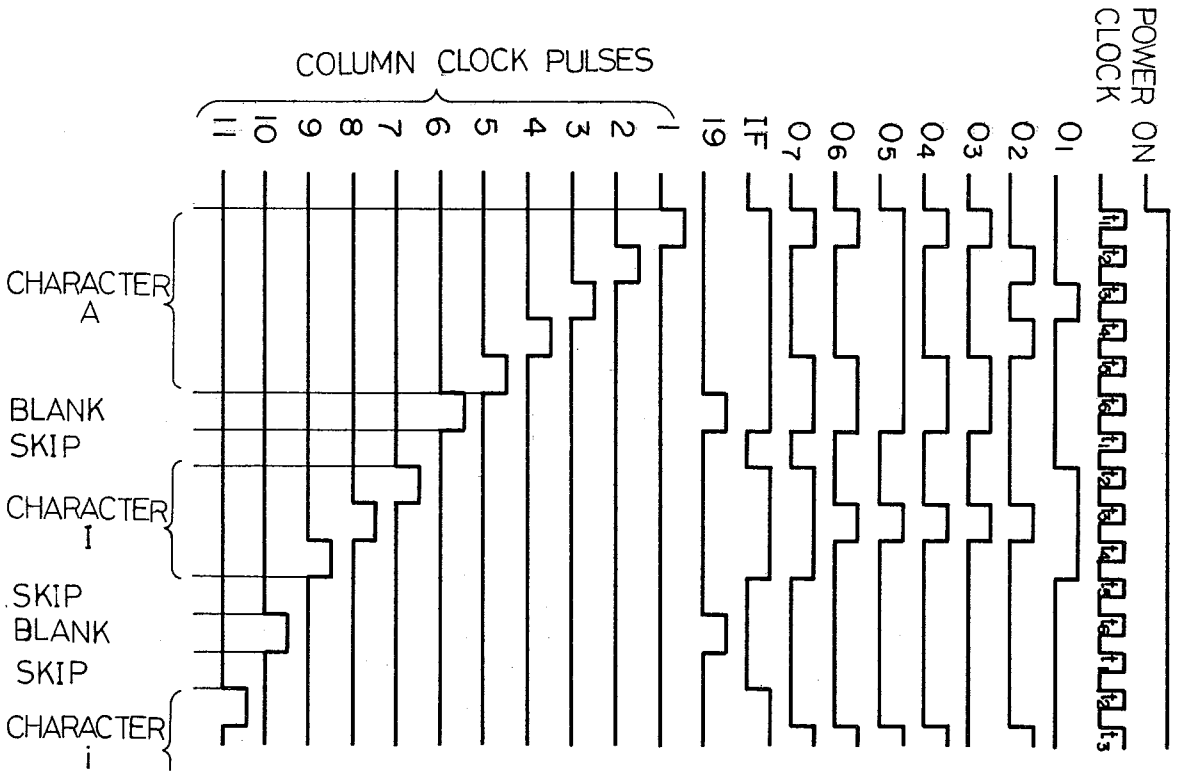
FIG. 6 is a timing diagram of the apparatus of FIG. 5.

The novel feature of the present invention will now be described with reference also being made to the timing diagram of FIG. 6. As illustrated in FIG. 3, the character generator 14 is adapted to generate a dot code bit IF which is logically high when the corresponding column contains at least one character dot and logically low when the column does not contain a character dot or is blank. For example, the leftmost column of the character "A" contains character dots 03 to 07. Thus, the bit code IF is logically high (1). The first column of the character "I" does not contain a character dot (01 to 07 are logically low (0)), so the dot code is logically low or zero.

The dot codes IF are applied through the OR gate 33 to the AND gate 23 which constitutes an inhibition means. When the dot code IF is high, indicating that the column contains at least one character dot, the AND gate 23 is enabled, allowing the corresponding clock pulse to be applied to the counter 22 to select the next column position in the display 12. However, when the code IF is logically low, indicating that the column is blank, the AND gate 23 is inhibited and the corresponding clock pulse is prevented from reaching the counter 22. Thus, the counter 22 is not incremented and the column position in the display 12 is not changed. This has the effect of causing the display 12 to skip the blank columns as illustrated in FIGS. 2 and 6 and provide the advantages described above.

In summary, it will be seen that the present invention provides an improved multi-character dot matrix display in which blank columns in characters are eliminated. This has the effect of improving the aesthetic quality of the display and enabling more characters to be displayed in the same space as compared to the prior art. However, the connection of the frequency divider 19 to the AND gate 23 through the OR gate 33 ensures that there will be a blank column between each character for legibility. Various modifications will become possible for those skilled in the art after receiving the teachings of the present disclosure without departing from the scope thereof. For example, the present invention is equally applicable to a display in which the driver 17 is adapted to drive cathode, rather than anode inputs.

What is claimed is:

1. A dot martrix display apparatus including a multi-digit dot matrix display means having a predetermined number of columns and a column enable input for each respective column, character generator means for generating and applying to the display means column of characters corresponding to input character codes and column designation means for sequentially applying column enable signals to the column enable inputs for designating respective column positions in the display means for displaying the columns, characterized by comprising:

inhibition means for inhibiting the column designation means from designating a next column position when a column generated by the character generator means does not contain a character dot; and clock pulse generator means for generating clock pulses, the character generator means generating next columns in response to the clock pulses and the column designation means designating next column positions in response to the clock pulses, the inhibition means being disposed between the clock pulse generator means and the column designation means for preventing clock pulses corresponding to columns which do not contain character dots from reaching the column designation means.

2. An apparatus as in claim 1, in which the character generator is constructed to generate, in addition to each column, a dot code which has a first value when the respective column contains a character dot and a second value when the respective column does not contain a character dot, the inhibition means inhibiting the column designation means from designating the next column position when the dot code has the second value.

3. An apparatus as in claim 1, in which the inhibition means comprises a counter-decoder.

4. An apparatus as in claim 2, the inhibition means preventing clock pulses corresponding to columns for which the respective dot codes have the second value from reaching the column designation means.

5. An apparatus as in claim 1, in which the character generator means is constructed to generate a blank column after the columns of each character, the inhibition means allowing the column designation means to designate a next column position corresponding to each blank column.

6. A dot matrix display apparatus including a multi-character dot matrix display means, character generator means for generating and applying to the display means columns of characters corresponding to input character codes and column designation means for sequentially designating column positions in the display means for displaying the columns, characterized by comprising:

inhibition means for inhibiting the column designation means from designating a next column position when a column generated by the character generator means does not contain a character dot;

clock pulse generator means for generating clock pulses, the character generator means generating next columns in response to the clock pulses and the column designation means designating next column positions in response to the clock pulses, the inhibition means being disposed between the clock pulse generator means and the column designation means for preventing clock pulses corresponding to columns which do not contain character dots from reaching the column designation means; and a frequency divider for frequency dividing the clock pulses by a ratio equal to a number of columns in each character plus a blank column to produce a blank column pulse in response to said number of clock pulses, the inhibition means unconditionally designating next column positions in response to the respective blank column pulses.

* * * * *